United States Patent [19]

Hamm

[11] 4,438,608

[45] Mar. 27, 1984

[54] STAIRTREAD FOR SPIRAL STAIRCASE

[76] Inventor: Wilfried Hamm, Im Wiesengrund 28, 4330 Mulheim an der Ruhr, Fed. Rep. of Germany

[21] Appl. No.: 232,911

[22] Filed: Feb. 9, 1981

[30] Foreign Application Priority Data

Feb. 28, 1980 [DE] Fed. Rep. of Germany ... 8005300[U]

[51] Int. Cl.[3] ..... E04F 11/02; E04F 11/08

[52] U.S. Cl. ..... 52/187; 52/189

[58] Field of Search ..... 52/177, 179, 180, 181, 52/182-191, 397, 403, 393, 489

[56] References Cited

U.S. PATENT DOCUMENTS

| | | | |
|---|---|---|---|
| 194,580 | 8/1877 | Clark | 52/393 |
| 580,262 | 4/1897 | Dyer | 52/187 |
| 1,031,645 | 7/1912 | Haskell | 52/187 |
| 1,215,352 | 2/1917 | Duvinage | 52/187 |
| 1,726,133 | 8/1929 | Wilson | 52/187 |
| 3,585,769 | 6/1971 | Giuseppe | 52/187 |
| 3,713,260 | 1/1973 | Brauckmann | 52/187 |
| 4,321,294 | 3/1982 | Naka | 52/188 |

FOREIGN PATENT DOCUMENTS

| | | | |
|---|---|---|---|
| 2155603 | 11/1972 | Fed. Rep. of Germany | 52/187 |
| 2320966 | 11/1974 | Fed. Rep. of Germany | 52/187 |
| 2349378 | 4/1975 | Fed. Rep. of Germany | 52/187 |
| 1066662 | of 1954 | France | 52/489 |
| 575060 | 4/1976 | Switzerland | 52/187 |

*Primary Examiner*—Alfred C. Perham

*Attorney, Agent, or Firm*—McCormick, Paulding & Huber

[57] ABSTRACT

Pie shaped stairtreads are mounted to a vertical column with spacers to provide a desired riser height. Each tread includes a tubular sleeve with a T-shaped frame welded to the sleeve. The frame extends peripherally of the pie shaped tread and includes two radially sides and a short arcuate segment welded to the outer radial ends opposite the tubular sleeve. The tread includes a perforated steel plate welded to the frame, which plate and frame are covered by a polyurethane foam. A railing rod can be mounted to the outer arcuate frame segment by bracket means clamped to the web of the T in either one of two positions for left hand or right hand stairway installations.

3 Claims, 4 Drawing Figures

STAIRTREAD FOR SPIRAL STAIRCASE

The invention concerns a stairtread for spiral staircases. The stairtreads are usually made of high grade wood or stone. Stairtreads are also known to consist of a combination of wood and carpet covering. All these designs however have the disadvantage that either they make use of raw materials which have recently become expensive or are expensive to manufacture.

The purpose of the invention is to provide a stairtread which is cheap as regards material and manufacture, but nevertheless incorporates a very good design, that is to say its practicability also fulfills the exacting requirements of domestic staircase construction.

This problem is solved by the invention by a T-section iron frame welded on to a central tubular sleeve, a perforated plate attached to the top of the frame, a covering of soft polyurethane integral foam extending on all sides and filling the cavities, a carpet covering let in to the latter whose ends fit in to pockets provided in the polyurethane covering, and a stair-railing clamp fastening fitted on the T-section iron frame consisting of the T-section iron frame itself, a fork and clamp screw.

An additional feature of the invention resulting from the step height of the stairtreads suited to the place of installation consists of the fact that elastic covering spacing collars of soft polyurethane integral foam are located between the individual stairtread elements on the newel.

The invention is explained in detail with the aid of the following drawings.

Figure 1:
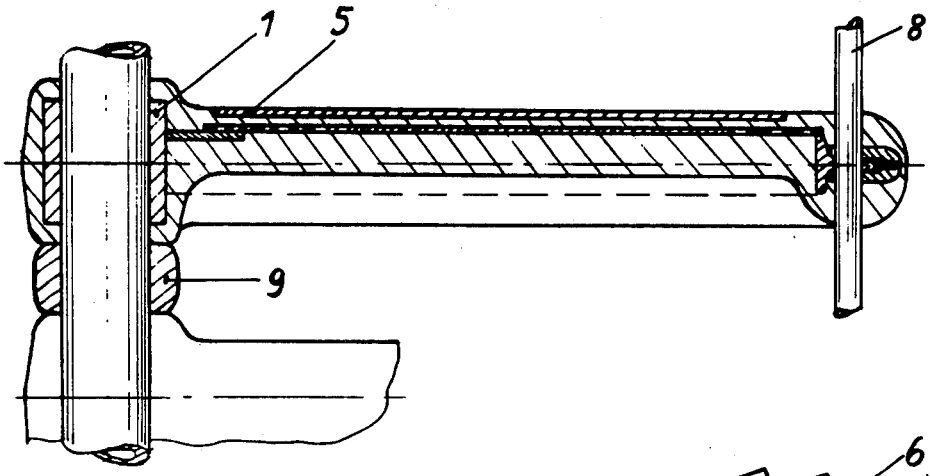
FIG. 1 shows a longitudinal section through the stairtread.
Figure 2:
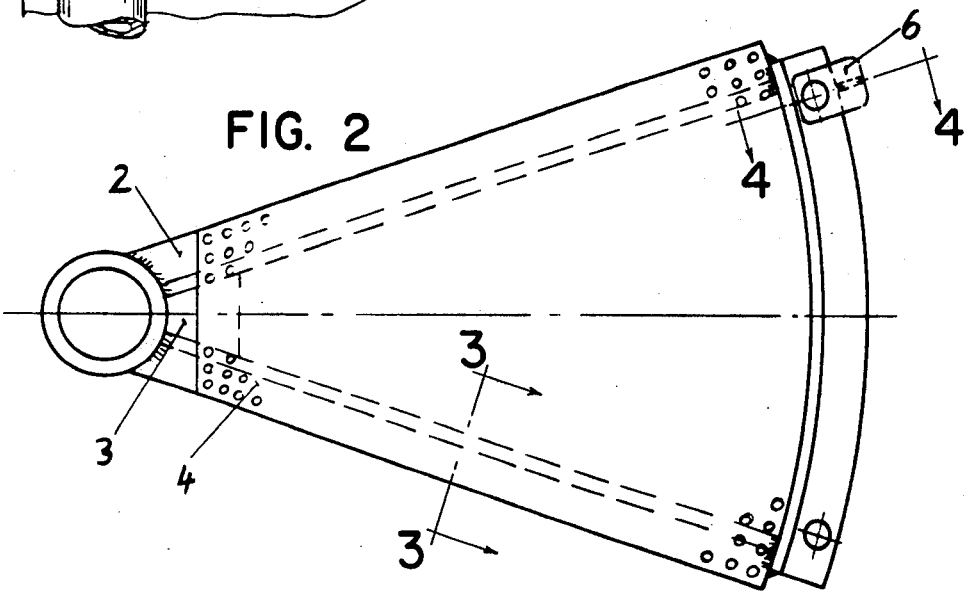
FIG. 2 shows a plan view of the stairtread.
Figure 3:
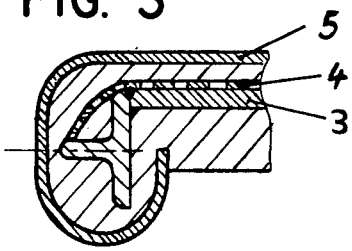
FIG. 3 shows a cross section of the stairtread, enlarged.
Figure 4:
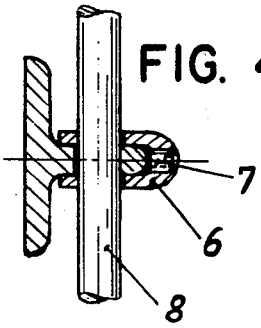
FIG. 4 shows the clamp fastening of the stair-railing rod, enlarged.

A T-Section iron frame (2) is welded on to the central tubular sleeve (1). To brace the frame a gusset plate (3) is also provided at its front end whilst a perforated plate, expanded metal or similar device (4) welded on along the entire frame ensures uniform distribution of the polyurethane foam. The entire steel structure is covered with soft polyurethane integral foam, has a recess in the step face area to accommodate carpeting material which—cutable to size by the user himself—can for example be secured in the recess by means of double sided adhesive tape. The carpeting material (5) is drawn around the sides of the stair tread and its ends inserted in pockets provided for the purpose on the underside of the stairtread. A stair-railing fastening which in particular also makes provision for vertical adjustment of the stairtreads is formed from the T-section iron frame, the fork (6) and the clamp screw (7). Tightening clamp screw (7) clamps stair-railing rod (8) against the stairtread. The elastic spacing collars (9) of polyurethane foam are used to cover up the newel intervals resulting in each case from the step height of the stairtreads in question.

Thus the stairtread simultaneously combines all desirable properties. Material and production costs are low. Its complete covering of polyurethane foam inhibits corrosion and provides sound absorption, has low dead weight, can be used as righthand as well as lefthand and with the facility for inserting carpeting material meets the most exacting styling requirements. Its clamp fastening for the stair-railing rods also ensures quick, economical assembly of the entire staircase.

I claim:

1. In a staircase of the spiral type having individual treads projecting radially from a vertical support column, the improvement to such treads wherein each tread comprises:

(a) a frame having radially extending sides with inner and outer ends, a tubular sleeve welded to the inner ends of said sides, an outer segment welded to the outer ends of said frame sides, said sides and segment being of T-shaped cross section with the stem of the T oriented horizontally and welded to said sleeve at said inner ends of said sides, (b) a formed steel plate welded to upper marginal edges of said T-shaped sides and having downwardly bent marginal side portions welded to margianl edges of said stems of said T-shaped frame sides, said plate being perforated, (c) a polyurethane foam covering means encasing said frame sides and said steel plate to define thickened and rounded marginal portions along said radially extending frame sides, said polyurethane foam means defining downwardly open radially extending slots adjacent said edges, and (d) carpeting provided on the upwardly facing surface of said polyurethane covering and marginal edges of said carpeting received in said slots, said polyurethane covering means being recessed to receive said carpeting.

2. The combination of claim 1 further characterized by bracket means mounted to the horizontally extending stem portion of said T-shaped outer frame segment, said bracket means comprising a U-shaped fork having spaced legs connected by a base with openings in the legs of the U adapted for alignment with one of two railing rod openings in said stem portion of said T-shaped outer frame segment, and a clamping screw threadably received in the base of said U-shaped fork to urge said clamp and the railing rod in said railing rod openings toward the vertically oriented portion of said T-shaped outer frame segment.

3. The combination of claim 2 further characterized by spacing collars between the individual stairtreads.

* * * * *